US009216596B1

(12) United States Patent
Suzuki

(10) Patent No.: US 9,216,596 B1
(45) Date of Patent: Dec. 22, 2015

(54) PRINTING APPARATUS AND COMMODITY INFORMATION PROCESSING APPARATUS

(71) Applicant: TOSHIBA TEC KABUSHIKI KAISHA, Shinagawa-ku, Tokyo (JP)

(72) Inventor: Minoru Suzuki, Sagamihara (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/444,288

(22) Filed: Jul. 28, 2014

(51) Int. Cl.
*B41J 2/325* (2006.01)
*B41J 11/66* (2006.01)
*B41J 2/32* (2006.01)

(52) U.S. Cl.
CPC . *B41J 11/663* (2013.01); *B41J 2/32* (2013.01)

(58) Field of Classification Search
USPC ..... 347/171, 179, 152, 222; 400/624
See application file for complete search history.

(56) References Cited

U.S. PATENT DOCUMENTS

| | | | | |
|---|---|---|---|---|
| 4,639,749 | A * | 1/1987 | Ito | 347/152 |
| 4,940,348 | A * | 7/1990 | Akers et al. | 400/624 |
| 2005/0117013 | A1 * | 6/2005 | Hayashi | 347/179 |

* cited by examiner

*Primary Examiner* — Kristal Feggins
(74) *Attorney, Agent, or Firm* — Amin, Turocy & Watson, LLP

(57) ABSTRACT

In accordance with one embodiment, a printing apparatus comprises a conveyance section, a print head, an erasing head, a cutter and a control section. The conveyance section conveys roll paper. The print head carries out printing with color erasable ink on the roll paper conveyed forward by the conveyance section. The erasing head erases the color of the color erasable ink printed on the roll paper conveyed backward by the conveyance section. The cutter cuts the roll paper printed by the print head. The control section determines whether or not to cut the roll paper by the cutter, controls the conveyance section to convey the roll paper backward in a case of not cutting the roll paper, and controls the erasing head to erase the color of the color erasable ink printed on the roll paper.

10 Claims, 11 Drawing Sheets

PRINTING APPARATUS AND COMMODITY INFORMATION PROCESSING APPARATUS

FIELD

Embodiments described herein relate to a printing apparatus and a commodity information processing apparatus.

BACKGROUND

A commodity information processing apparatus such as a POS (point-of-sales) terminal reads, for example, a commodity identification code such as a barcode to recognize the commodity. The commodity information processing apparatus can carry out settlement processing based on the recognition result of the commodity and an input operation. Further, the commodity information processing apparatus comprises a printing apparatus which can print the result of the settlement processing as a receipt.

The printing apparatus prints on, for example, roll paper. The printing apparatus cuts the roll paper subjected to printing processing to issue a receipt. There is a printing apparatus which determines whether or not the receipt is needed according to the input, and carries out printing and cutting processing to issue a receipt as needed. However, such a printing apparatus carries out printing after the necessity of the receipt is input, which takes much time for issuing the receipt.

DETAILED DESCRIPTION

In accordance with one embodiment, a printing apparatus comprises a conveyance section, a print head, an erasing head, a cutter and a control section. The conveyance section conveys roll paper. The print head carries out printing with color erasable ink on the roll paper conveyed forward by the conveyance section. The erasing head erases the color of the color erasable ink printed on the roll paper conveyed backward by the conveyance section. The cutter cuts the roll paper printed by the print head. The control section determines whether or not to cut the roll paper by the cutter, controls the conveyance section to convey the roll paper backward in a case of not cutting the roll paper, and controls the erasing head to erase the color of the color erasable ink printed on the roll paper.

Hereinafter, embodiments of the printing apparatus and the commodity information processing apparatus are described with reference to the accompanying drawings. The embodiments are applied to a store checkout system arranged in a checkout counter in a store such as a supermarket and the like.

A First Embodiment

Figure 1:
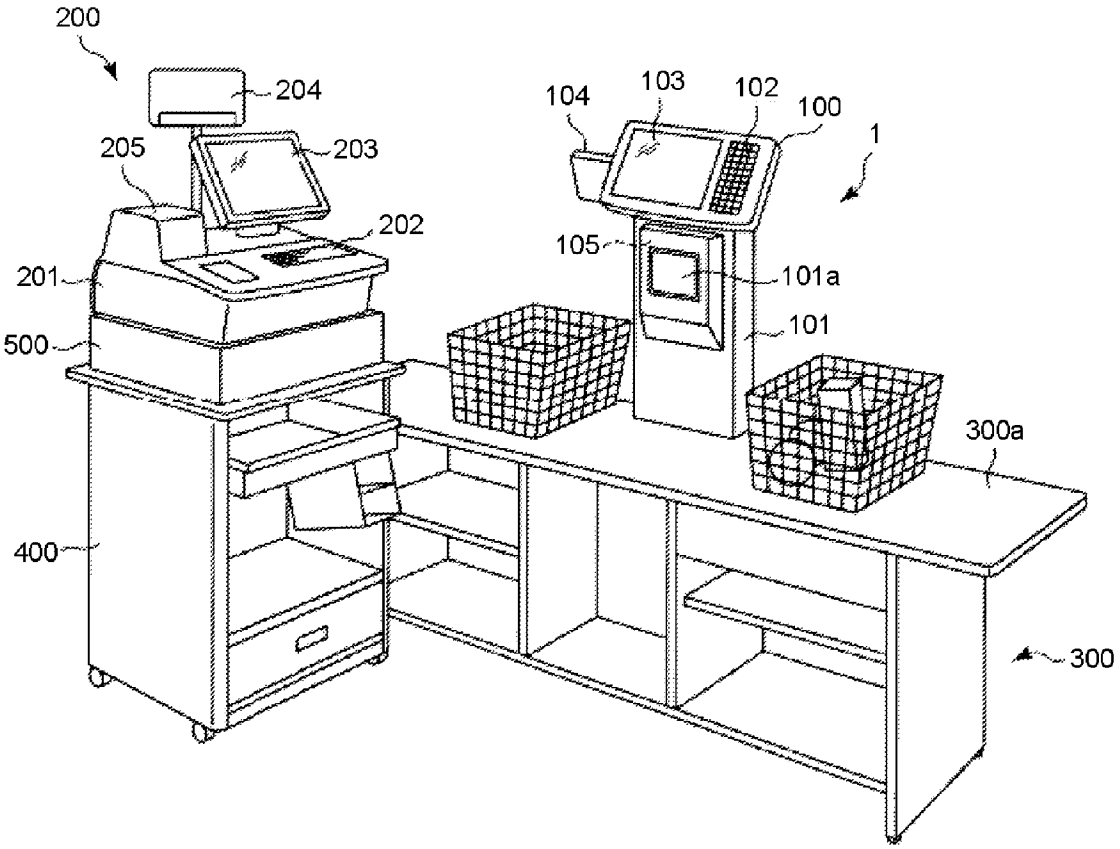
FIG. 1 is a diagram illustrating an example of a commodity information processing apparatus according to one embodiment.

FIG. 1 is an external view of a commodity information processing apparatus 1 according to the first embodiment. The commodity information processing apparatus 1 comprises a commodity recognition apparatus 100 and a POS (point of sales) terminal 200. The commodity recognition apparatus 100 is arranged on a checkout counter 300. The POS terminal 200 is arranged on a drawer 500 arranged on a register table 400. The commodity recognition apparatus 100 and the POS terminal 200 are electrically connected with each other through a communication cable (not shown). An automatic change dispensing machine may be arranged instead of the drawer 500.

The commodity recognition apparatus 100 is provided with a housing 101, a keyboard 102, a touch panel 103, a customer display 104 and an image capturing section 105. The commodity recognition apparatus 100 can read a commodity identification code such as a barcode attached to a commodity to recognize the commodity.

The housing 101 formed into a flat type box stands on the checkout counter 300. The housing 101 supports the keyboard 102, the touch panel 103 and the customer display 104 on the upper end thereof. Further, the housing 101 supports the image capturing section 105 inside.

The housing 101 includes a reading window 101*a*. The image capturing section 105 of the housing 101 includes a camera arranged facing to the reading window 101*a* inside the housing 101 behind the reading window 101*a* and an illumination device arranged around the camera. The camera photographs a commodity (object) positioned in front of the reading window 101*a* through the reading window 101*a*. The illumination device irradiates the commodity in front of the reading window 101*a* with light through the reading window 101*a*.

The POS terminal 200 includes a housing 201, a keyboard 202, an operator display 203, a customer display 204 and a printer 220.

The housing 201 supports the keyboard 202 in such a manner that part of the keyboard 202 is exposed outside. The housing 201 supports the operator display 203 and the customer display 204 in such an exposed manner. Further, the housing 201 supports the printer 220 inside.

The checkout counter 300 includes an elongated top plate 300*a*. The checkout counter 300 divides the space into a customer path (rear side in FIG. 1) along the longitudinal direction of the top plate and an operator space (front side in FIG. 1). The housing 101 is arranged at the approximate center of the longitudinal direction of the top plate 300*a* in such a manner that the keyboard 102, the touch panel 103 and the reading window 101*a* face the operator space while the customer display 104 faces the customer path. On the upper surface of the top plate 300*a*, an area at the upstream side of the commodity recognition apparatus 100 in the customer moving direction is used as a space for placing unregistered commodities within the commodities a customer desires to purchase, and an area at the downstream side of the commodity recognition apparatus 100 in the customer moving direction is used as a space for placing registered commodities.

The register table 400 is positioned in the operator space at the downstream end part of the checkout counter 300 in the moving direction of the customer in the customer path.

Figure 2:
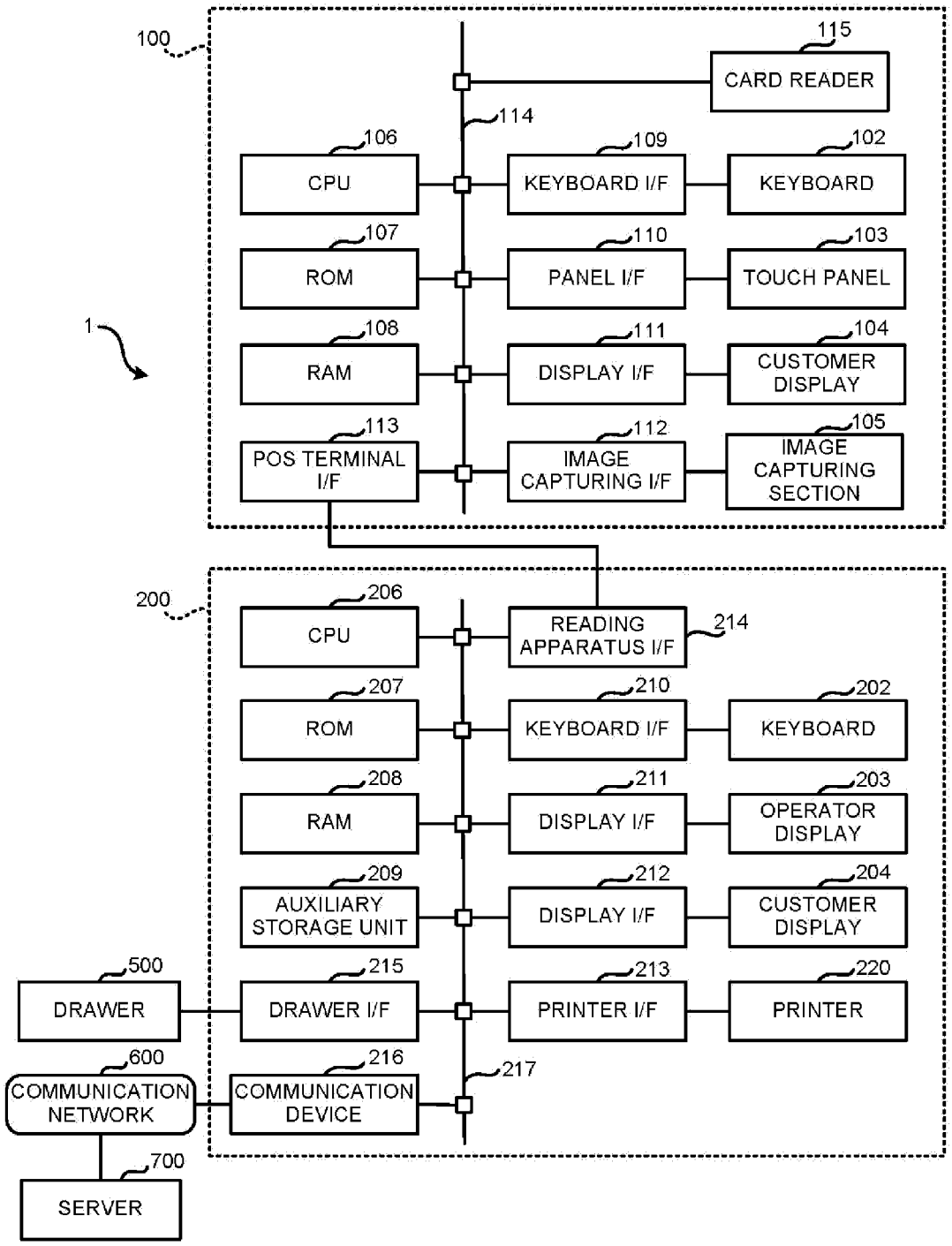
FIG. 2 is a diagram illustrating an example of a control system of the commodity information processing apparatus according to the embodiment.

FIG. 2 is a block diagram illustrating electrical components in the store checkout system shown in FIG. 1. In addition, in the components shown in FIG. 2, the same components as those shown in FIG. 1 are applied with the same reference numerals.

The commodity recognition apparatus 100 comprises, as electrical components, the keyboard 102, the touch panel 103, the customer display 104, the image capturing section 105, a CPU (central processing unit) 106, a ROM (read-only memory) 107, a RAM (random-access memory) 108, a keyboard interface (keyboard I/F) 109, a panel interface (panel I/F) 110, a display interface (display I/F) 111, an image capturing interface (image capturing I/F) 112, a POS terminal interface (POS terminal I/F) 113, a bus line 114 and a card reader 115. The bus line 114 including an address bus and a data bus and the like connects the CPU 106, the ROM 107, the RAM 108, the keyboard interface 109, the panel interface 110, the display interface 111, the image capturing interface 112, the POS terminal interface 113 and the card reader 115 with each other.

The keyboard 102, consisting of a plurality of key switches, outputs a command indicating the content of an operation of an operator on these key switches.

The touch panel 103 includes, for example, a display device such as a LCD (liquid crystal display) and a transparent two-dimensional touch sensor overlapped on the display screen of the display device. The display device displays an image based on the control of the CPU 106. For example, the commodity recognition apparatus 100 displays guidance for an operator on the display device of the touch panel 103.

The two-dimensional touch sensor of the touch panel 103 detects the position of a touch of the operator on the display screen of the display device and outputs the detection result as coordinate data.

A notification section such as a speaker may be arranged in the touch panel 103. The speaker of the touch panel 103 outputs a speech or voice based on the control of the CPU 106. For example, the commodity recognition apparatus 100 outputs a guidance speech to the operator through the speaker of the touch panel 103. That is, the touch panel 103 functions as a notification section for giving various notification to the operator.

The customer display 104 displays a character string or an image based on the control of the CPU 106. The customer display 104 is used to display various character strings or images to be indicated to a customer. The customer display 104 may be, for example, a fluorescent tube display or a LCD and the like.

As stated above, the image capturing section 105 is provided with the camera, which includes an image capturing lens and a CCD (charge coupled device) image capturing element serving as an area image sensor, and the illumination device arranged around the lens of the camera. The image capturing lens focuses an image of an image capturing area on the CCD image capturing element. In this way, the camera acquires the image (frame image) of the image capturing area and outputs the frame image.

Further, the image capturing section 105 recognizes a commodity identification code based on the frame image output from the camera. For example, in a case where the commodity identification code is a barcode, the image capturing section 105 carries out a given analysis processing on the frame image output from the camera to recognize the commodity identification code. That is, the image capturing section 105 functions as a code reading device.

The CPU 106 is a central part of a computer. The CPU 106 controls each component of the commodity recognition apparatus 100 to realize various operations of the commodity recognition apparatus 100 according to an operating system, middleware and application program stored in the ROM 107 and the RAM 108.

The ROM 107 is a main storage part of the computer. The ROM 107 stores the operating system. As occasion demands, the ROM 107 also stores the middleware and the application program mentioned above, and the data referred to when the CPU 106 carries out various processing.

The RAM 108 is also a main storage part of the computer mentioned above. The RAM 108 stores data referred to when the CPU 106 carries out various processing. Further, the RAM 108 is also used as a so-called work area for storing the data temporarily used when the CPU 106 carries out various processing.

The application program stored in the ROM 107 includes a control program relating to a commodity reading processing described later. In addition, the transfer of the commodity recognition apparatus 100 is generally carried out in a state in which the control program is stored in the ROM 107. Alternatively, an auxiliary storage device such as an EEPROM (electric erasable programmable read-only memory), a hard disk drive or a SSD (solid state drive) is arranged in the commodity recognition apparatus 100, and the commodity recognition apparatus 100 may be transferred in a state in which the control program is stored in the auxiliary storage device. However, the commodity recognition apparatus 100 can be transferred in a state in which the control program is not stored in the ROM 107 or the auxiliary storage device. The control program is transferred by being recorded in a removable recording medium such as a magnetic disc, a magnetic optical disk, an optical disk, a semiconductor memory and the like, or transferred through a network, and then the control program is written in the auxiliary storage device of the commodity recognition apparatus 100 transferred separately.

The keyboard interface 109 mediates the transfer of data between the keyboard 102 and the CPU 106. The keyboard interface 109 may be used as a well-known device interface based on, for example, a PS/2 standard or a USB (universal serial bus) standard.

The panel interface 110 mediates the transfer of data and image signal between the touch panel 103 and the CPU 106. The panel interface 110 includes an interface for display device and an interface for touch sensor. The interface for display device may be used as a well-known device interface based on, for example, a VGA (video graphics array) standard (analog RGB standard), a DVI (digital video interface) standard or a LVDS (low voltage differential signaling) standard. The interface for touch sensor may be used as a well-known device interface based on, for example, a USB standard or a RS (recommended standard)-232C standard.

The display interface 111 mediates the transfer of image signal between the customer display 104 and the CPU 106. The display interface 111 may be used as a well-known device based on, for example, the USB standard or the RS-232C standard in a case where the customer display 104 is a fluorescent display, and may be used as a well-known device interface based on, for example, the VGA standard, the DVI standard or the LVDS standard in a case where the customer display 104 is a LCD.

The image capturing interface 112 mediates the transfer of data between the image capturing section 105 and the CPU 106. The image capturing interface 112 may be used as a well-known device interface based on, for example, the USB standard or an IEEE (institute of electrical and electronic engineers) 1394 standard.

The POS terminal interface 113 mediates the transfer of data between the POS terminal 200 and the CPU 106. The POS terminal interface 113 may be used as a well-known device interface based on, for example, the USB standard or the RS-232C standard.

The card reader 115 reads a card such as a member card and the like. The card reader 115 has a function of communicating with the member card through a non-contact communication or a contact communication. Further, the card reader 115 may include a magnetic reading head. The card reader 115 reads an ID of the member card through a non-contact communication, a contact communication or the magnetic reading head. Further, the commodity recognition apparatus 100 may recognize the barcode printed in the member card through the image capturing section 105 to read the ID of the member card. The card reader 115 sends the ID read from the member card to the POS terminal 200.

The card reader 115 may be a card reader for reading an electronic settlement card. In this case, the card reader 115 communicates with the card through a non-contact communication or a contact communication to read balance information and the ID of the card from the card. The commodity recognition apparatus 100 sends the balance information and the ID to the POS terminal 200. The POS terminal 200 carries out a settlement processing based on the balance information and total amount of the commodities, and sends a command instructing to rewrite the balance information in the card based on the settlement result to the commodity recognition apparatus 100. The commodity recognition apparatus 100 rewrites the balance information in the card in response to the received command.

The POS terminal 200 comprises, as electrical components, the keyboard 202, the operator display 203, the customer display 204, the printer 220, a CPU 206, a ROM 207, a RAM 208, an auxiliary storage unit 209, a keyboard interface 210, display interfaces (display I/F) 211 and 212, a printer interface (printer I/F) 213, a reading apparatus interface (reading apparatus I/F) 214, a drawer interface (drawer I/F) 215, a communication device 216 and a bus line 217. The bus line 217 including an address bus and a data bus and the like connects the CPU 206, the ROM 207, the RAM 208, the auxiliary storage unit 209, the keyboard interface 210, the display interface 211, the display interface 212, the printer interface 213, the reading apparatus interface 214, the drawer interface 215 and the communication device 216 with each other.

The keyboard 202, consisting of a plurality of key switches, outputs a command indicating the content of an operation of an operator on these key switches.

The operator display 203 displays any image under the control of the CPU 206. The operator display 203 is used to display various images to be indicated to the operator. The operator display 203 may be, for example, a LCD.

The customer display 204 displays any character string or image under the control of the CPU 206. The customer display 204 is used to display various character strings or images to be indicated to a customer. The customer display 204 may be, for example, a fluorescent tube display or a LCD and the like.

The printer 220 prints a receipt image indicating the content of a transaction on receipt paper under the control of the CPU 206. The printer 220 carries out printing with erasable ink (color erasable ink). The constitution of the printer 220 is described later.

The CPU 206 is a central part of a computer. The CPU 206 controls each section to realize various operations of the POS terminal 200 according to an operating system, middleware and application program stored in the ROM 207 and the RAM 208.

The ROM 207 is a main storage part of the computer. The ROM 207 stores the operating system. As occasion demands, the ROM 207 also stores the middleware and the application program mentioned above, and the data referred to when the CPU 206 carries out various processing.

The RAM 208 is also a main storage part of the computer mentioned above. The RAM 208 stores data referred to when the CPU 206 carries out various processing. Further, the RAM 208 is used as a so-called work area for storing the data temporarily used when the CPU 206 carries out various processing. Part of the storage area of the RAM 208 is used as a commodity list area for managing information of commodities subjected to sales registration.

The auxiliary storage unit 209 is an auxiliary storage part of the computer mentioned above. For example, the auxiliary storage unit 209 is a hard disk drive or a SSD for storing data used when the CPU 206 carries out various processing or data generated in the processing carried out by the CPU 206.

For example, the auxiliary storage unit 209 stores an ID and a mail address in an associated manner. In this way, the POS terminal 200 can read, from the auxiliary storage unit 209, the mail address associated with the ID read from the card by the card reader 115 of the commodity recognition apparatus 100. In this way, for example, the POS terminal 200 can send the result of the settlement processing to the read mail address as electronic receipt instead of paper receipt.

The keyboard interface 210 mediates the transfer of data between the keyboard 202 and the CPU 206. The keyboard interface 210 may be used as a well-known device interface based on, for example, the PS/2 standard or the USB (universal serial bus) standard.

The display interface 211 mediates the transfer of image signal between the operator display 203 and the CPU 206. The display interface 211 may be used as a well-known device interface based on, for example, the VGA standard, the DVI standard or the LVDS standard.

The display interface 212 mediates the transfer of image signal between the customer display 204 and the CPU 206. The display interface 212 may be used as a well-known device based on, for example, the USB standard or the RS-232C standard in a case where the customer display 204 is a fluorescent display, and may be used as a well-known device interface based on, for example, the VGA standard, the DVI standard or the LVDS standard in a case where the customer display 204 is a LCD.

The printer interface 213 mediates the transfer of data between the printer 220 and the CPU 206. The printer interface 213 may be used as a well-known device interface based on, for example, the USB standard, the RS-232C standard or an IEEE1284 standard (the so-called centronics standard).

The reading apparatus interface 214 mediates the transfer of data between the commodity recognition apparatus 100 and the CPU 206. The reading apparatus interface 214 may be used as a well-known device interface based on the standard of the POS terminal interface 113.

The drawer interface 215 outputs a driving signal indicating to open the drawer 500 to the drawer 500 in response to the drawer opening instruction from the CPU 206.

The communication device 216 communicates with a server 700 through the communication network 600. The communication device 216 may be, for example, an existing LAN communication device.

The server 700 stores database associated with, for example, information indicating the commodity identification code, commodity name and fee.

The commodity recognition apparatus 100 recognizes the commodity identification code from the commodity through the image capturing section 105. The commodity recognition apparatus 100 sends the recognized commodity identification code to the POS terminal 200.

The POS terminal 200 accesses the database of the server 700, and recognizes the commodity name, and the fee associated with the commodity identification code received from the commodity recognition apparatus 100. The POS terminal 200 calculates a total amount serving as the sum of the amounts of the commodities. Further, the POS terminal 200 recognizes a deposit amount indicating an amount entrusted from a user according to an input operation of the operator. The POS terminal 200 carries out settlement processing based on the deposit amount and the total amount. That is, the POS terminal 200 subtracts the total amount from the deposit amount to calculate the change amount.

The CPU 206 of the POS terminal 200 generates a receipt image based on the result of the settlement processing as the printing data. In this case, the receipt image includes the display indicating a store name, store address information, the date and time when the settlement processing is carried out, the commodity name, the amount of each commodity, the total amount, the deposit amount, the change amount and the like. The CPU 206 of the POS terminal 200 supplies the generated printing data for the printer 220 through the printer I/F 213. The printer 220 can carry out printing according to the received printing data. In this way, the POS terminal 200 can output a receipt based on the printing data from the printer 220.

In addition, the processing for registering the information indicating the commodity identification code, commodity name and fee in the database may be carried out by the commodity information processing apparatus 1 or by other general personal computer.

The commodity information processing apparatus 1 may download the database of the server 700 in advance. In this case, the commodity information processing apparatus 1 downloads the database of the server 700 in advance to a storage section such as the auxiliary storage unit 209 of the POS terminal 200. In a case where the commodity identification code is recognized by the commodity recognition apparatus 100, the commodity information processing apparatus 1 recognizes the commodity name and fee associated with the recognized commodity identification code by reference to the database stored in the auxiliary storage unit 209 of the POS terminal 200.

Figure 3:
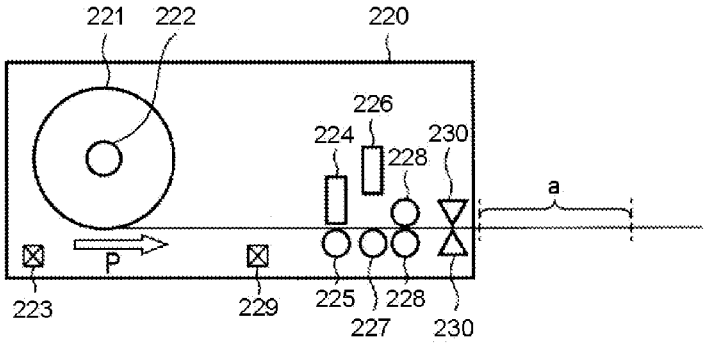
FIG. 3 is a diagram illustrating an example of a printing apparatus according to the embodiment.
Figure 4:
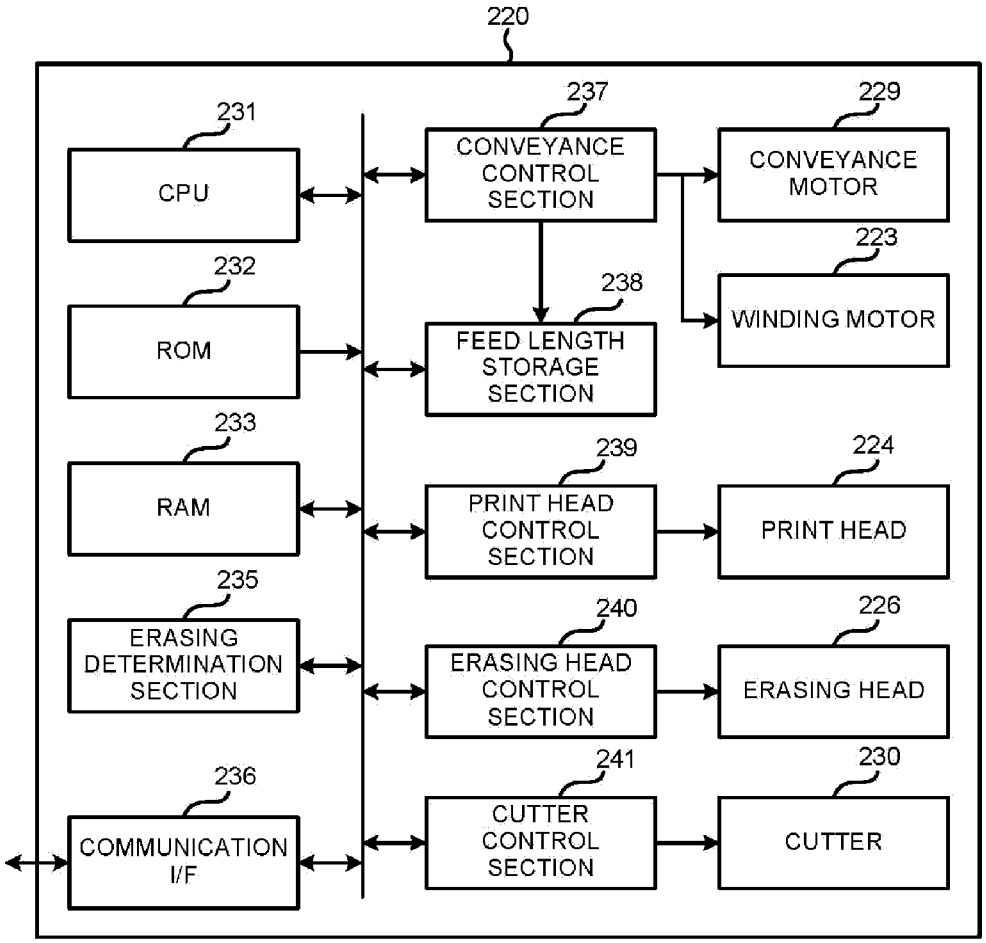
FIG. 4 is a diagram illustrating a control system of the printing apparatus according to the embodiment.

FIG. 3 and FIG. 4 are diagrams illustrating an example of the constitution of the printer 220. FIG. 3 is a diagram illustrating an example of the arrangement of each section of the printer 220. FIG. 4 is a diagram illustrating an example of the control system of the printer 220.

A CPU 231 executes a program stored in a ROM 232 to enable the printer 220 to carry out receipt printing processing for printing a receipt based on the printing data sent from the POS terminal 200. The printer 220 may also print a receipt in an electrophotographic manner with erasable toner (color erasable toner) instead of carrying out receipt printing processing with color erasable ink.

As shown in FIG. 3, the printer 220 comprises a rotation shaft 222 where the roll paper 221 serving as printing medium is mounted, a winding motor 223, a print head 224, a printing platen roller 225, an erasing head 226, an erasing platen roller 227, conveyance rollers 228, a conveyance motor 229 and a cutter 230. Further, as shown in FIG. 4, the printer 220 comprises a CPU 231, a ROM 232, a RAM 233, a HDD 234, an erasing determination section 235, a communication I/F 236, a conveyance control section 237, a feed length storage section 238, a print head control section 239, an erasing head control section 240 and a cutter control section 241.

The roll paper 221 is obtained by winding paper in a roll shape. The roll paper 221 includes a winding shaft. In a case where the winding shaft of the roll paper 221 is mounted, the rotation shaft 222 can fix the roll paper 221 in a rotatable manner.

The winding motor 223 can rotate the rotation shaft 222. The winding motor 223 is, for example, a steeping motor. The steeping motor is driven by, for example, pulse power, and rotates a single step per pulse of electrical signal. In this way, the conveyance control section 237 controlling the operations of the winding motor 223 can recognize the distance for which the winding motor 223 is operated. Further, the winding motor 223 can change the rotation direction thereof according to the polarity of the applied pulse.

For example, in a case where the roll paper 221 is mounted on the rotation shaft, the winding motor 223 can rotate the rotation shaft 222 to rotate the roll paper 221 mounted on the rotation shaft 222. In this way, the winding motor 223 can wind the roll paper 221.

The print head 224 carries out printing on the roll paper 221 with color erasable ink. In a case of carrying out printing through the print head 224, the printing platen roller 225 presses the roll paper 221 against the print head 224.

The erasing head 226 carries out color erasing processing to erase the color erasable ink printed on the roll paper 221. In a case of carrying out color erasing processing through the erasing head 226, the erasing platen roller 227 presses the roll paper 221 against the erasing head 226. In a case of not carrying out color erasing processing, the erasing head 226 is arranged away from the roll paper 221 for a given distance. Further, the erasing head 226 is arranged in such a manner that the position (erasing position) where the erasing head 226 is pressed against the roll paper 221 is located between a position (printing position) where printing is carried out by the print head 224 and a position (cutting position) where the roll paper 221 is cut by the cutter 230.

The color erasable ink is erased if the temperature thereof reaches a given temperature (erasable temperature). For example, the erasing head 226 heats the color erasable ink printed on the roll paper 221 to raise the temperature to the erasable temperature to erase the color erasable ink.

The conveyance rollers 228 are driven by the conveyance motor 229. The conveyance rollers 228 are arranged to nip the roll paper 221.

The conveyance motor 229 can rotate the conveyance rollers 228. The conveyance motor 229 is, for example, a steeping motor. The steeping motor is driven by, for example, pulse power, and rotates a single step per pulse of electrical signal. In this way, the conveyance control section 237 controlling the operations of the conveyance motor 229 can recognize the distance for which the conveyance motor 229 is operated.

Further, the conveyance motor 229 can change the rotation direction thereof according to the polarity of the applied pulse.

The conveyance motor 229 can rotate the conveyance rollers 228 nipping the roll paper 221 to convey the roll paper 221 in a direction indicated by an arrow P. In this way, the conveyance motor 229 can convey the roll paper 221 to the printing position of the print head 224, the erasing position of the erasing head 226 and the cutting position of the cutter 230.

The cutter 230 cuts the roll paper 221 at a given cutting position. In this way, the printer can discharge the roll paper 221 to the outside of the printer 220 as a receipt.

The CPU 231 is a central part of a computer. The CPU 231 controls each section to realize various operations of the printer 220 according to an operating system, middleware and application program stored in the ROM 232 and the RAM 233.

The ROM 232 is a main storage part of the computer. The ROM 232 stores the operating system. As occasion demands, the ROM 232 also stores the middleware and the application program mentioned above, and the data referred to when the CPU 231 carries out various processing.

The RAM 233 is also a main storage part of the computer mentioned above. The RAM 233 stores data referred to when the CPU 231 carries out various processing. Further, the RAM 233 is used as a so-called work area for storing the data temporarily used when the CPU 231 carries out various processing. Part of the RAM 233 is used as a storage area for temporarily storing the printing data.

The erasing determination section 235 determines whether or not to execute color erasing processing by the erasing head 226. For example, the erasing determination section 235 determines whether or not to execute color erasing processing by the erasing head 226 according to an input operation. Further, the erasing determination section 235 determines whether or not to execute color erasing processing by the erasing head 226 based on whether or not to issue a receipt as an electronic receipt.

The communication I/F 236 is an interface for connection with the printer I/F 213 of the POS terminal 200. The printer 220 can receive the printing data from the POS terminal 200 through the communication I/F 236 and the printer I/F 213.

The conveyance control section 237 controls the operations of the winding motor 223 and the conveyance motor 229. The conveyance control section 237 can sequentially recognize where the front end of the roll paper 221 is on the conveyance path according to the operation time and the rotation speed of each of the winding motor 223 and the conveyance motor 229. Further, the printing position of the print head 224, the erasing position of the erasing head 226 and the cutting position of the cutter 230 are already known. Thus, the conveyance control section 237 can sequentially recognize positions from the front end of the roll paper 221 to the printing position of the print head 224, the erasing position of the erasing head 226 and the cutting position of the cutter 230, respectively.

The feed length storage section 238 is a storage area for storing the feed distance of the roll paper 221. The feed length storage section 238 may be arranged in the RAM 233, or be arranged in the printer 220 as separate memory. The feed length storage section 238 can recognize the area where printing is carried out by the print head 224 on the roll paper 221 according to the position of the roll paper 221 recognized by the conveyance control section 237. That is, the CPU 231 can sequentially recognize the position of the area where printing is carried out on the roll paper 221 according to the storage content of the feed length storage section 238.

The print head control section 239 controls the operations of the print head 224. The print head control section 239 controls the operations of the print head 224 according to the printing data. In this way, the printer 220 can print information corresponding to the printing data on the roll paper 221. As stated above, the receipt image is printed on the roll paper 221 as the printing data, thus, the printer 220 can issue a receipt corresponding to the result of the settlement processing.

The erasing head control section 240 controls the operations of the erasing head 226. As stated above, the CPU 231 of the printer 220 can recognize the area where printing is carried out by the print head 224. Further, as stated above, the printer 220 can control the operations of the winding motor 223 and the conveyance motor 229 by the conveyance control section 237 to back feed the roll paper 221 to wind the roll paper 221 on the rotation shaft 222. The CPU 231 of the printer 220 controls the conveyance control section 237 to back feed the roll paper 221 to convey the area (printed area) on the roll paper 221 where printing is carried out by the print head 224 to the erasing position of the erasing head 226. In this way, the CPU 231 of the printer 220 can carry out color erasing processing to erase the color erasable ink of the printed area on the roll paper 221 through the erasing head 226.

The cutter control section 241 controls the operations of the cutter 230. For example, in a case where a cutting command (cutting command) is received from the CPU 231, the cutter control section 241 controls the cutter 230 to cut the roll paper 221 at the cutting position.

In addition, the CPU 231 executes the programs stored in the ROM 232 to realize the functions of the erasing determination section 235, the conveyance control section 237, the print head control section 239, the erasing head control section 240 and the cutter control section 241.

Figure 5:
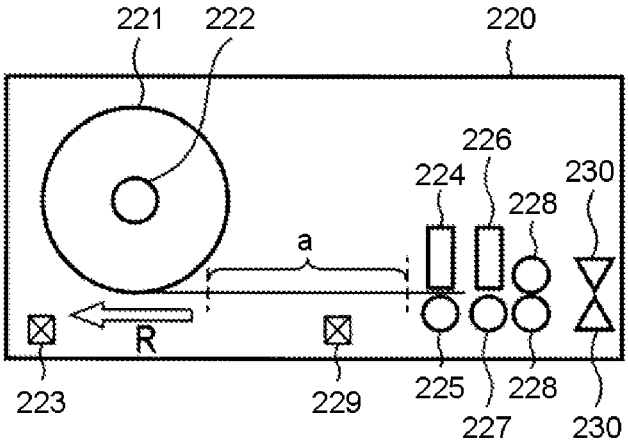
FIG. 5 is a diagram illustrating an example of the printing apparatus according to the embodiment.

An area a on the roll paper 221 shown in FIG. 3 is an area subjected to receipt printing processing by the print head 224. For example, in a case of carrying out color erasing processing on the color erasable ink printed on the area a, as shown in FIG. 5, the printer 220 operates the winding motor 223 through the conveyance control section 237 to back feed the roll paper 221 in a direction indicated by an arrow R. Further, when the area a reaches the erasing position of the erasing head 226, the erasing head control section 240 of the printer 220 drives the erasing head 226 to contact the erasing head 226 with the roll paper 221. In this way, the printer 220 can erase the color erasable ink printed on the area a of the roll paper 221.

Figure 6:
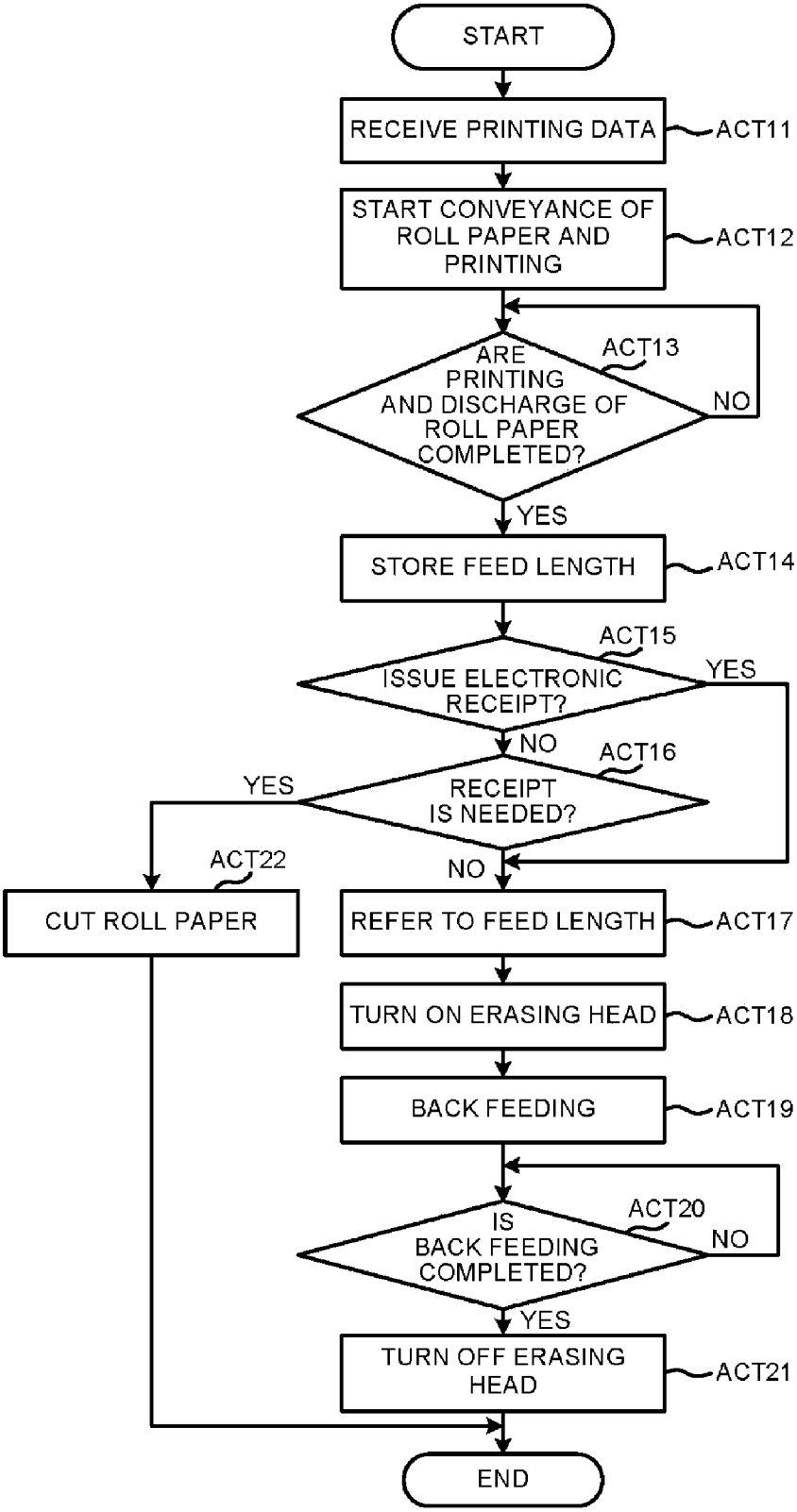
FIG. 6 is a diagram illustrating an example of the operations of the printing apparatus according to the embodiment.

FIG. 6 is a diagram illustrating an example of the operations of the printer 220.

In a case where the printing data is received, the CPU 231 of the printer 220 temporarily stores the received printing data in, for example, the RAM 233 and the like (ACT 11).

The CPU 231 controls the conveyance control section 237 and the print head control section 239 according to the printing data to convey the roll paper 221 and carry out printing on the roll paper 221 by the print head 224 (ACT 12).

The CPU 231 determines whether or not the conveyance of the roll paper 221 and the printing on the roll paper 221 by the print head 224 are completed (ACT 13).

If it is determined that the conveyance of the roll paper 221 and the printing on the roll paper 221 by the print head 224 are completed, the CPU 231 stores the feed length in the feed length storage section 238 (ACT 14). For example, the CPU 231 stores the distance from the front end of the roll paper 221 of the area a where printing is carried out by the print head 224 in the feed length storage section 238 as the feed length. In this way, the CPU 231 can recognize the position of the area where printing is carried out with color erasable ink by reference to the feed length storage section 238.

The CPU 231 determines whether or not an electronic receipt can be issued (ACT 15). For example, in a case where the commodity recognition apparatus 100 reads ID from the member card or the electronic settlement card before the processing in ACT 15, and a mail address for electronic receipt is associated with the read ID, the CPU 231 determines that an electronic receipt can be issued. If the CPU 231 determines that the electronic receipt can be issued, later-described ACT 17 is taken.

On the other hand, if it is determined that the electronic receipt cannot be issued, the CPU 231 determines whether or not it is necessary to issue a receipt according to an input operation (ACT 16). For example, the CPU 206 of the POS terminal 200 generates a screen (receipt necessity selection screen) for the operator to select the necessity of the receipt. The receipt necessity selection screen includes, for example, the display of characters for urging the operator to determine whether or not to issue a receipt, a YES button and a NO button. The CPU 206 displays the receipt necessity selection screen on, for example, the touch panel 103 or the operator display 203.

The CPU 206 determines whether or not it is necessary to issue a receipt according to an input operation on the receipt necessity selection screen. For example, the CPU 206 determines that it is necessary to issue a receipt in a case where the YES button on the receipt necessity selection screen is selected. In this case, the CPU 206 inputs a command (cutting command) to the printer 220 to instruct the printer 220 to cut the roll paper 221. If the cutting command is received from the CPU 206, the CPU 231 determines that it is necessary to issue a receipt.

On the other hand, in a case where the NO button on the receipt necessity selection screen is selected, the CPU 206 determines that it is not necessary to issue a receipt. In this case, the CPU 206 inputs a command (erasing command) to the printer 220 to instruct the printer 220 to carry out color erasing processing on the printed area of the roll paper 221. If the erasing command is received from the CPU 206, the CPU 231 determines that it is not necessary to issue a receipt. Further, the CPU 206 may also display the receipt necessity selection screen on, for example, the customer display 104 or 204.

If it is determined that the electronic receipt can be issued in ACT 15, or if it is determined that the receipt is not needed in ACT 16, the CPU 231 recognizes the feed length by reference to the feed length storage section 238 (ACT 17). That is, the CPU 231 recognizes the position of the area where printing is carried out in the former receipt printing processing.

The CPU 231 controls the erasing head control section 240 to turn on the erasing head 226 (ACT 18). The CPU 231 back feeds the roll paper 221 for a length corresponding to the feed length recognized in ACT 17 (ACT 19). Further, the CPU 231 determines whether or not the back feeding of the roll paper 221 for a length corresponding to the feed length recognized in ACT 17 is completed (ACT 20). That is, the CPU 231 can carry out color erasing processing on the area where printing is carried out in the former receipt printing processing by turning on the erasing head 226 and back feeding the roll paper 221. If it is determined that the back feeding is completed in ACT 20, the CPU 231 turns off the erasing head 226 (ACT 21), and then ends the processing.

On the other hand, if it is determined that the receipt is needed in ACT 16, the CPU 231 controls the cutter control section 241 to operate the cutter 230. In this way, the CPU 231 can cut the roll paper 221 and issue a receipt (ACT 22).

As stated above, the printer 220 prints the receipt image on the roll paper 221 based on the instruction of the commodity information processing apparatus 1. Further, in a case where it is not necessary to issue the receipt, the printer 220 back feeds the roll paper 221 and carries out color erasing processing on the area of the roll paper 221 where printing is carried out. In this way, the printer 220 can reuse the roll paper 221 subjected to color erasing processing for the next printing. Thus, the printer 220 can prevent the waste of the printing paper without impairing the convenience of the customer. As a result, a printing apparatus and a commodity information processing apparatus with high convenience can be provided.

In addition, it is exemplified in the embodiment described above that the CPU 206 of the POS terminal 200 determines the necessity of the receipt according to an operation of button on the receipt necessity selection screen, however, the present invention is not limited to this. For example, the CPU 206 may determine that the receipt is not needed in a case where the recognition of a next commodity is carried out by the commodity recognition apparatus 100 during the display of the receipt necessity selection screen. In this case, the commodity information processing apparatus 1 can carry out color erasing processing on the area of the roll paper 221 printed by the printer 220 without an operation from the operator.

A Second Embodiment

Figure 7:
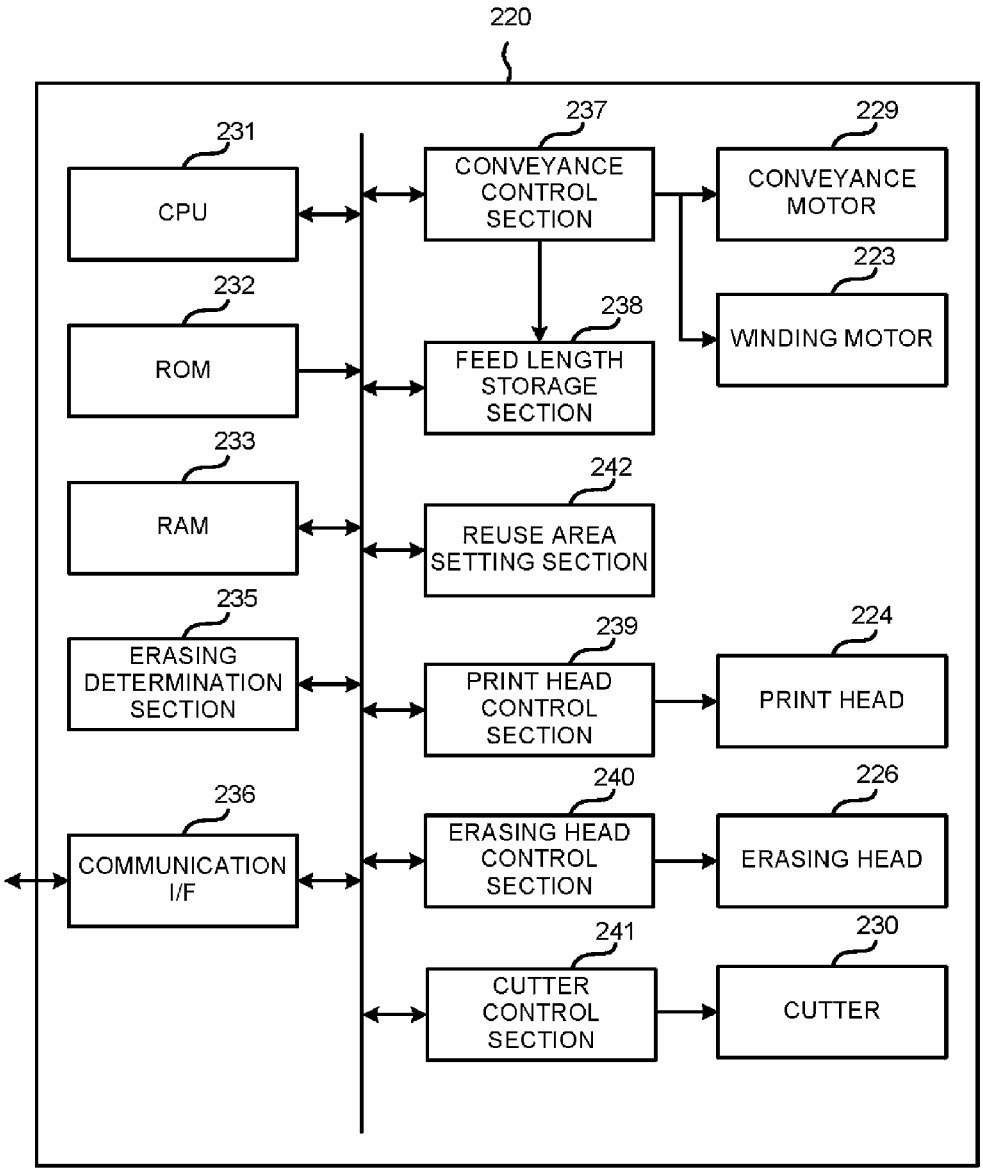
FIG. 7 is a diagram illustrating a control system of a printing apparatus according to a second embodiment.

FIG. 7 is a diagram illustrating an example of the control system of the printer 220 according to the second embodiment. In addition, the same constitutions as the printer 220 described in the first embodiment shown in FIG. 4 are applied with the same reference numerals, and the detailed descriptions thereof are not repeated.

Compared with the printer 220 shown in FIG. 4, the printer 220 shown in FIG. 7 further comprises a reuse area setting section 242.

Figure 8:
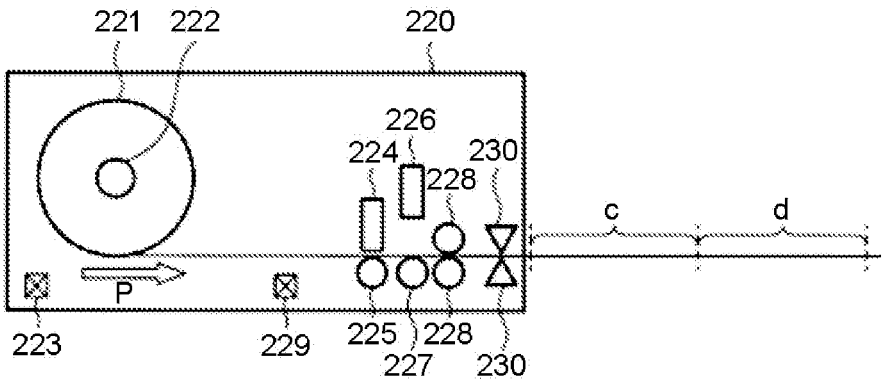
FIG. 8 is a diagram illustrating an example of the printing apparatus according to the second embodiment.

The reuse area setting section 242 sets an area which is not subjected to erasing processing by the erasing head 226. For example, as shown in FIG. 8, there is a printed area c and a printed area d on the roll paper 221. The printed area c is an area where the commodity name, the amount and the like are printed, and the printed area d is an area where the same printing content such as the store name, advertisement and the like are printed every time. Such an area where the same printing content is printed every time can be used in the next printing without being subjected to color erasing processing.

For example, the reuse area setting section 242 sets the printed area c as an area which is to be subjected to the color erasing processing by the erasing head 226, and sets the printed area d as an area (reuse area) which is not to be subjected to the color erasing processing by the erasing head 226.

Figure 9:
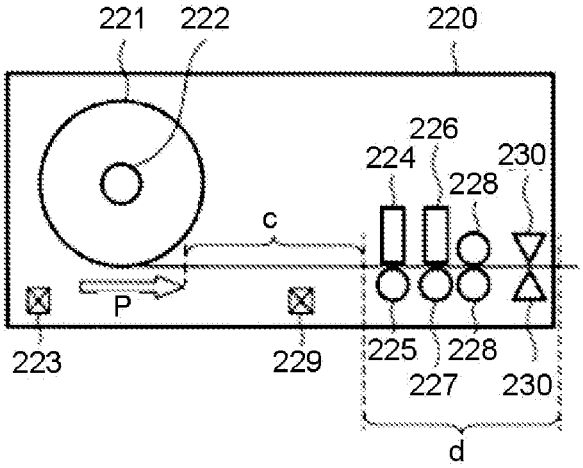
FIG. 9 is a diagram illustrating an example of the printing apparatus according to the second embodiment.

In a case where the printed area c is set as an area which is to be subjected to the color erasing processing and the printed area d is set as a reuse area, as shown in FIG. 9, the printer 220 back feeds the roll paper to subject the printed area c to color erasing processing by the erasing head 226. Further, the CPU 231 of the printer 220 adjusts the feed length of the back feeding carried out by the winding motor 223 to stop the printed area d set as the reuse area before the printed area d is back fed to the erasing position of the erasing head 226.

For example, the CPU 231 subtracts a distance (reuse area length) from the front end of the roll paper 221 of the area set as the reuse area from a distance (feed length) from the front end of the roll paper 221 of the printed area to obtain a feed length. The CPU 231 back feeds the roll paper for the obtained feed length and meanwhile carries out color erasing processing by the erasing head 226, in this way, the reuse area is remained without being subjected to color erasing processing.

Figure 10:
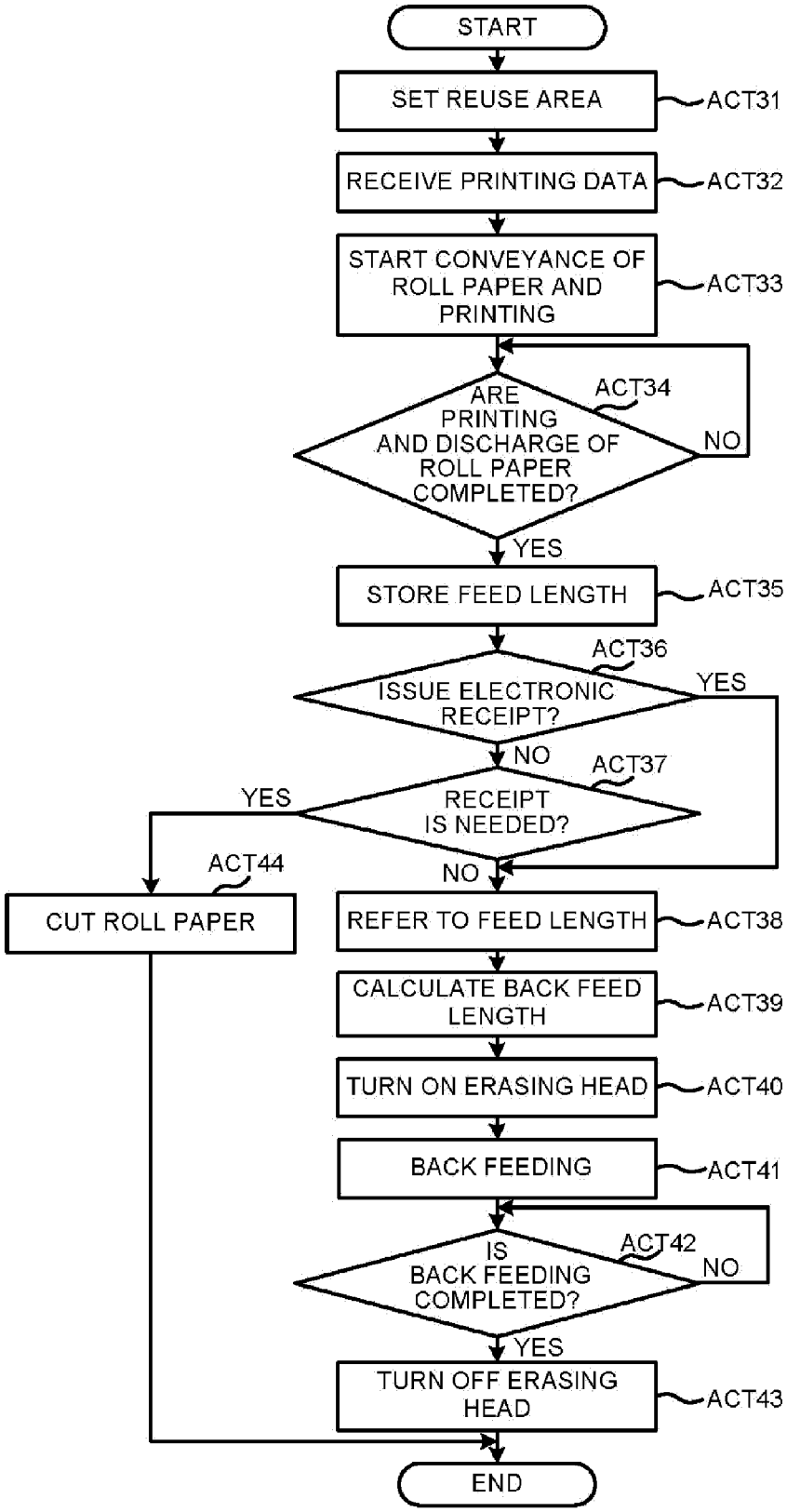
FIG. 10 is a diagram illustrating an example of the operations of the printing apparatus according to the second embodiment.

FIG. 10 is a diagram illustrating another example of the operations of the printer 220.

First, the CPU 231 of the printer 220 sets a reuse area through the reuse area setting section 242 (ACT 31). In addition, the reuse area may also be set in advance instead of being set in the flowchart shown in FIG. 10.

The CPU 231 receives the printing data and temporarily stores the received printing data in, for example, the RAM 233 and the like (ACT 32).

The CPU 231 controls the conveyance control section 237 and the print head control section 239 according to the printing data to convey the roll paper 221 and carry out printing on the roll paper 221 by the print head 224 (ACT 33).

The CPU 231 determines whether or not the conveyance of the roll paper 221 and the printing on the roll paper 221 by the print head 224 are completed (ACT 34).

If it is determined that the conveyance of the roll paper 221 and the printing on the roll paper 221 by the print head 224 are completed, the CPU 231 stores the feed length in the feed length storage section 238 (ACT 35).

The CPU 231 determines whether or not an electronic receipt can be issued (ACT 36).

If it is determined that the electronic receipt cannot be issued, the CPU 231 determines whether or not it is necessary to issue a receipt according to an input operation (ACT 37)

If it is determined that the electronic receipt can be issued in ACT 36, or if it is determined that the receipt is not needed in ACT 37, the CPU 231 recognizes the feed length by reference to the feed length storage section 238 (ACT 38). That is, the CPU 231 recognizes the position of the area where printing is carried out in the former receipt printing processing.

Then the CPU 231 calculates the back feed length (ACT 39). For example, the CPU 231 calculates the length obtained by subtracting the length of the reuse area set by the reuse area setting section 242 from the feed length stored in ACT 35 as the back feed length.

The CPU 231 controls the erasing head control section 240 to turn on the erasing head 226 (ACT 40). The CPU 231 back feeds the roll paper 221 for a length corresponding to the back feed length calculated in ACT 39 (ACT 41). Further, the CPU 231 determines whether or not the back feeding of the roll paper 221 for a length corresponding to the back feed length calculated in ACT 39 is completed (ACT 42). That is, the CPU 231 can carry out color erasing processing on the area where printing is carried out in the former receipt printing processing except the reuse area by turning on the erasing head 226 and back feeding the roll paper 221. If it is determined that the back feeding is completed in ACT 42, the CPU 231 turns off the erasing head 226 (ACT 43), and then ends the processing.

On the other hand, if it is determined that the receipt is needed in ACT 37, the CPU 231 controls the cutter control section 241 to operate the cutter 230. In this way, the CPU 231 can cut the roll paper 221 and issue a receipt (ACT 44).

As stated above, the printer 220 can set the reuse area which is not subjected to color erasing processing by the erasing head 226 on the roll paper 221. That is, the printer 220 can set an area where the same printing content such as the store name, advertisement and the like are printed every time as the reuse area to prevent a problem that the same content is printed and erased repeatedly. There is a case where the number of times the roll paper 221 can be subjected to color erasing processing is pre-determined according to the quality of the paper. However, in accordance with the constitution described above, the number of times the printing and erasing processing is carried out repeatedly can be reduced, which can prevent the deterioration of the roll paper 221. As a result, the waste of the roll paper 221 and the color erasable ink can be prevented.

A Third Embodiment

Figure 11:
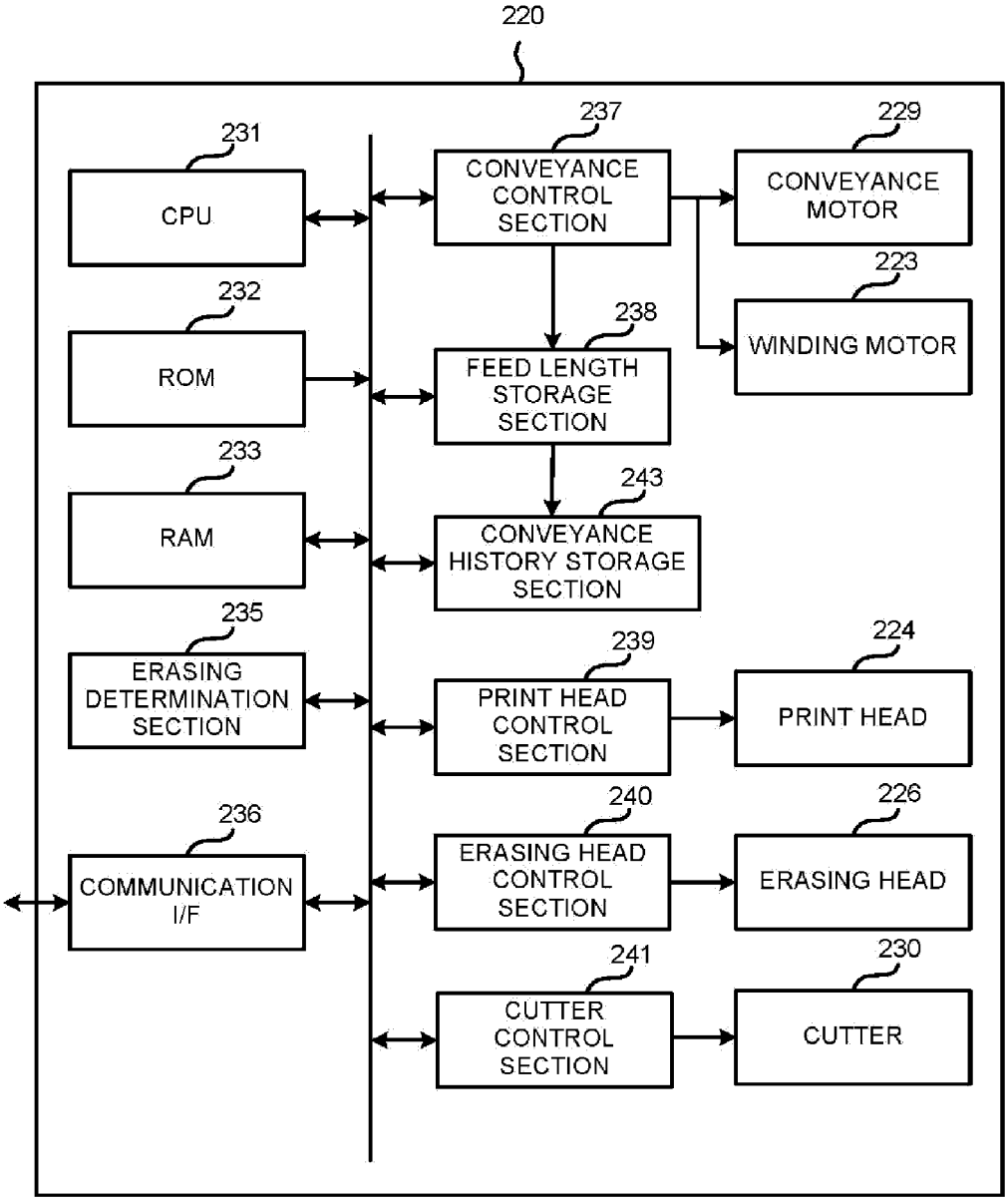
FIG. 11 is a diagram illustrating a control system of a printing apparatus according to a third embodiment.

FIG. 11 is a diagram illustrating an example of the control system of the printer 220 according to the third embodiment. In addition, the same constitutions as the printer 220 described in the first embodiment shown in FIG. 4 are applied with the same reference numerals, and the detailed descriptions thereof are not repeated.

Compared with the printer 220 shown in FIG. 4, the printer 220 shown in FIG. 11 further comprises a conveyance history storage section 243.

The conveyance history storage section 243 stores the length from the front end of the roll paper 221 subjected to past color erasing processing as the conveyance history (or erasing history). The CPU 231 can count, by reference to the conveyance history stored in the conveyance history storage section 243, the number of times the color erasing processing has been carried out for each of a plurality of areas obtained by dividing the roll paper 221 in the conveyance direction. The CPU 231 controls the cutter control section 241 and the conveyance control section 237 to cut, by the cutter 230, the area which has been subjected to color erasing processing for a number of times equal to the pre-determined limit number of times of erasing (for example, five times).

Figure 12:
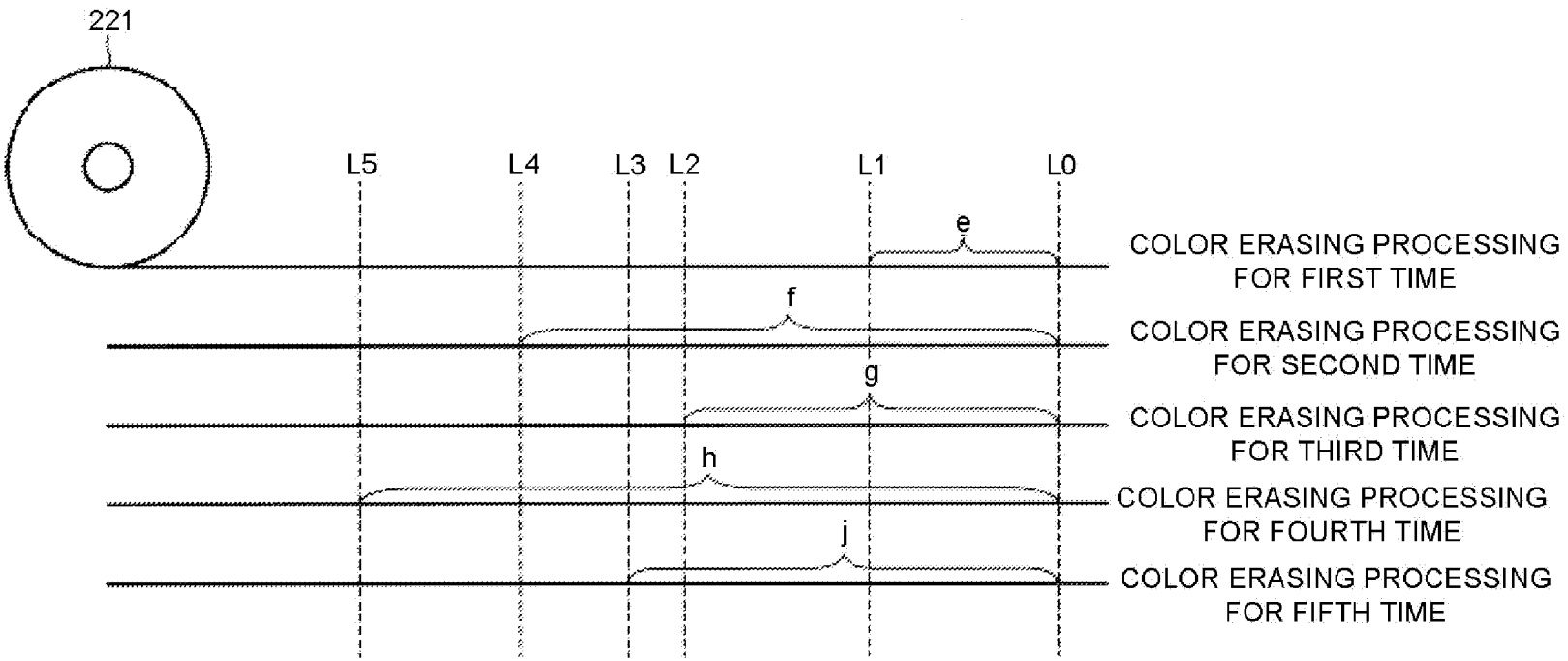
FIG. 12 is a diagram illustrating an example of the printing apparatus according to the third embodiment.

FIG. 12 is a diagram illustrating an example of the history of the color erasing processing. For example, in the color erasing processing for the first time, the color erasing processing is carried out on an area e from the position of L0 (the front end of the roll paper 221) to the position of L1 which is at a distance L1 from the front end. In the color erasing processing for the second time, the color erasing processing is carried out on an area f from the position of L0 (the front end of the roll paper 221) to the position of L4 which is at a distance L4 from the front end. In the color erasing processing for the third time, the color erasing processing is carried out on an area g from the position of L0 (the front end of the roll paper 221) to the position of L2 which is at a distance L2 from the front end. In the color erasing processing for the fourth time, the color erasing processing is carried out on an area h from the position of L0 (the front end of the roll paper 221) to the position of L5 which is at a distance L5 from the front end. Further, in the color erasing processing for the fifth time, the color erasing processing is carried out on an area j from the position of L0 (the front end of the roll paper 221) to the position of L3 which is at a distance L3 from the front end.

In a case where the color erasing processing is carried out as stated above, the area from the position of L0 (the front end of the roll paper 221) to the position of L1 which is at a distance L1 from the front end has been subjected to the color erasing processing for five times, that is, the limit number of times of erasing. In this case, the CPU 231 controls the cutter control section 241 and the conveyance control section 237 to cut, by the cutter 230, the area from the front end of the roll paper 221 to the position L1 which is at a distance L1 from the front end.

Figure 13:
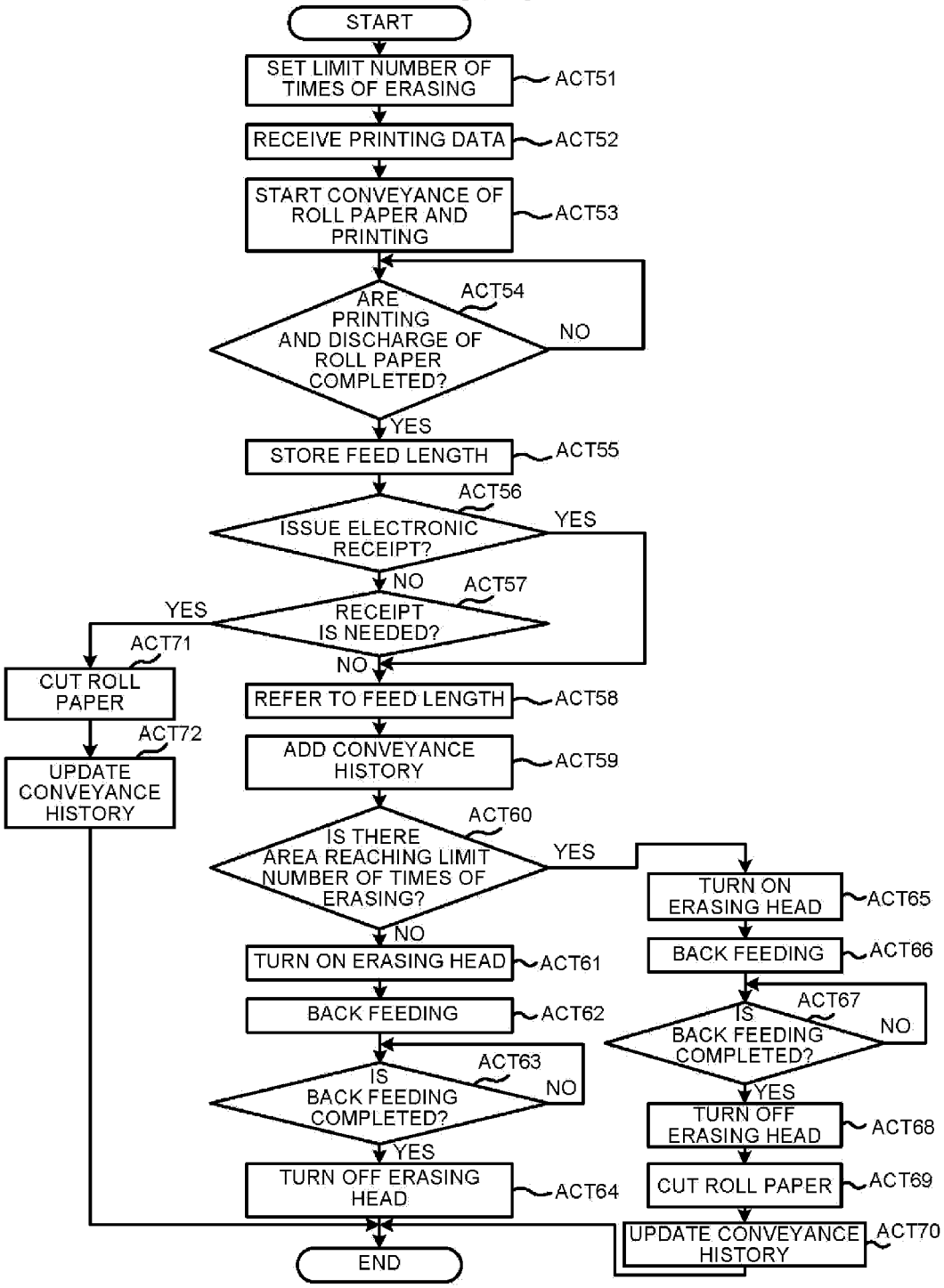
FIG. 13 is a diagram illustrating an example of the operations of the printing apparatus according to the third embodiment.

FIG. 13 is a diagram illustrating another example of the operations of the printer 220.

First, the CPU 231 of the printer 220 sets the limit number of times of erasing according to the conveyance history storage section 243 (ACT 51). In addition, the limit number of times of erasing may also be set in advance instead of being set in the flowchart shown in FIG. 13.

The CPU 231 receives the printing data and temporarily stores the received printing data in, for example, the RAM 233 and the like (ACT 52).

The CPU 231 controls the conveyance control section 237 and the print head control section 239 according to the printing data to convey the roll paper 221 and carry out printing on the roll paper 221 by the print head 224 (ACT 53).

The CPU 231 determines whether or not the conveyance of the roll paper 221 and the printing on the roll paper 221 by the print head 224 are completed (ACT 54).

If it is determined that the conveyance of the roll paper 221 and the printing on the roll paper 221 by the print head 224 are completed, the CPU 231 stores the feed length in the feed length storage section 238 (ACT 55).

The CPU 231 determines whether or not an electronic receipt can be issued (ACT 56).

If it is determined that the electronic receipt cannot be issued, the CPU 231 determines whether or not it is necessary to issue a receipt according to an input operation (ACT 57)

If it is determined that the electronic receipt can be issued in ACT 56, or if it is determined that the receipt is not needed in ACT 57, the CPU 231 recognizes the feed length by reference to the feed length storage section 238 (ACT 58). That is, the CPU 231 recognizes the position of the area where printing is carried out in the former receipt printing processing.

The CPU 231 adds the conveyance history to the conveyance history storage section 243 based on the recognized feed length (ACT 59). For example, the CPU 231 stores the distance from the front end of the roll paper 221 to the rear end of the area subjected to the color erasing processing in the conveyance history storage section 243 as the conveyance history.

Further, the CPU 231 determines whether or not there is an area which has been subjected to the color erasing processing for a number of times more than the limit number of times of erasing on the roll paper 221 (ACT 60). That is, the CPU 231 carries out the determination for each of a plurality of areas obtained by dividing the roll paper 221 in the conveyance direction by reference to the conveyance history storage section 243.

If it is determined that there is no area which has been subjected to the color erasing processing for a number of times more than the limit number of times of erasing on the roll paper 221 in ACT 60, the CPU 231 controls the erasing head control section 240 to turn on the erasing head 226 (ACT 61). The CPU 231 back feeds the roll paper 221 for a length corresponding to the feed length recognized in ACT 58 (ACT 62). Further, the CPU 231 determines whether or not the back feeding of the roll paper 221 for a length corresponding to the feed length recognized in ACT 58 is completed (ACT 63). That is, the CPU 231 can carry out color erasing processing on the area where printing is carried out in the former receipt printing processing by turning on the erasing head 226 and back feeding the roll paper 221. If it is determined that the back feeding is completed in ACT 63, the CPU 231 turns off the erasing head 226 (ACT 64), and then ends the processing.

On the other hand, if it is determined that there is an area which has been subjected to the color erasing processing for a number of times more than the limit number of times of erasing on the roll paper 221 in ACT 60, the CPU 231 controls the erasing head control section 240 to turn on the erasing head 226 (ACT 65). The CPU 231 back feeds the roll paper 221 for a length corresponding to the feed length recognized in ACT 58 (ACT 66). Further, the CPU 231 determines whether or not the back feeding of the roll paper 221 for a length corresponding to the feed length recognized in ACT 58 is completed (ACT 67). That is, the CPU 231 can carry out color erasing processing on the area where printing is carried out in the former receipt printing processing by turning on the erasing head 226 and back feeding the roll paper 221. If it is determined that the back feeding is completed in ACT 67, the CPU 231 turns off the erasing head 226 (ACT 68).

Then, the CPU 231 cuts, by the cutter 230, the area which is determined to have been subjected to the color erasing processing for a number of times more than the limit number of times of erasing in ACT 60 (ACT 69). For example, the CPU 231 controls the cutter control section 241 and the conveyance control section 237 to cut, by the cutter 230, the area from the front end of the roll paper 221 to the rear end of the area which is determined to have been subjected to the color erasing processing for a number of times more than the limit number of times of erasing in ACT 60. Then, the CPU 231 updates the conveyance history of the conveyance history storage section 243 according to the length of the area cut in ACT 69 (ACT 70), and then ends the processing. For example, the CPU 231 subtracts the length of the area cut in ACT 69 from the front end of the roll paper 221 from the length of each conveyance history of the conveyance history storage section 243. That is, the CPU 231 subtracts the length (from the front end of the roll paper 221 to the rear end of the area which is determined to have been subjected to the color erasing processing for a number of times more than the limit number of times of erasing in ACT 60) from each conveyance history of the conveyance history storage section 243.

On the other hand, if it is determined that the receipt is needed in ACT 57, the CPU 231 controls the cutter control section 241 to operate the cutter 230. In this way, the CPU 231 can cut the roll paper 221 and issue a receipt (ACT 71). Then the CPU 231 updates the conveyance history of the conveyance history storage section 243 according to the length of the area cut in ACT 71 (ACT 72), and then ends the processing.

As stated above, the printer 220 can set the limit number of times of erasing indicating the number of times the paper can be subjected to color erasing processing by the erasing head 226. In a case where the color erasing processing is carried out by the erasing head 226, the CPU 231 of the printer 220 stores the length from the front end of the roll paper 221 to the rear end of the area subjected to the color erasing processing in the conveyance history storage section 243 as the conveyance history. The CPU 231 controls the cutter control section 241 and the conveyance control section 237 to cut, by the cutter 230, the area which has been subjected to color erasing processing for a number of times equal to the pre-set limit number of times of erasing by reference to the conveyance history storage section 243. There is a case where printing disorder occurs if the number of times the same area is subjected to color erasing processing is increased. However, in accordance with the constitution described above, the printer 220 can set the limit number of times of erasing, thus, the quality of printing can be guaranteed.

In addition, the functions described in each embodiment stated above are not limited to the constitution using hardware, and the functions may be realized by reading the program in which each function is recorded using software in a computer. Further, each function may be constituted by selecting either of software and hardware properly.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a conveyance section configured to convey roll paper;

a print head configured to carry out printing with color erasable ink on the roll paper conveyed forward by the conveyance section;

an erasing head configured to erase the color of the color erasable ink printed on the roll paper conveyed backward by the conveyance section;

a cutter configured to cut the roll paper printed by the print head; and a control section configured to determine whether or not to cut the roll paper by the cutter, control the conveyance section to convey the roll paper backward in a case of not cutting the roll paper, and control the erasing head to erase the color of the color erasable ink printed on the roll paper.

2. The printing apparatus according to claim 1, further comprising:

a reuse area setting section configured to set an area from front end of the roll paper to a position at a given distance from the front end as a reuse area; wherein the control section controls the erasing head so as not to erase the color of the color erasable ink printed on the reuse area of the roll paper.

3. The printing apparatus according to claim 1, wherein

The control section stores a history of the color erasing processing carried out by the erasing head as the erasing history, and controls the cutter and the conveyance section to cut, by the cutter, an area which has been subjected to color erasing processing for a number of times equal to a pre-set limit number of times of erasing.

4. The printing apparatus according to claim 1, wherein the control section controls the cutter and the conveyance section to cut the roll paper by the cutter in a case where a cutting command instructing the printing apparatus to cut the roll paper is received from an external machine.

5. A commodity information processing apparatus, comprising:

a recognition section configured to recognize a commodity;

a printing data generation section configured to generate printing data for printing a receipt based on a recognition result of the recognition section and an input operation;

a conveyance section configured to convey roll paper;

a print head configured to carry out printing based on the printing data with color erasable ink on the roll paper conveyed forward by the conveyance section;

an erasing head configured to erase the color of the color erasable ink printed on the roll paper conveyed backward by the conveyance section;

a cutter configured to cut the roll paper printed by the print head; and a control section configured to determine whether or not to cut the roll paper by the cutter, control the conveyance section to convey the roll paper backward in a case of not cutting the roll paper, and control the erasing head to erase the color of the color erasable ink printed on the roll paper.

6. The commodity information processing apparatus according to claim 5, further comprising:

an ID reading section configured to read ID form a card; and a memory configured to store the ID and a mail address for electronic receipt in an associated manner; wherein the control section refers to the memory and determines not to cut the roll paper by the cutter in a case where there is a mail address for electronic receipt associated with the ID read from the card.

7. The commodity information processing apparatus according to claim 5, wherein the control section determines whether or not to cut the roll paper by the cutter according to an input operation.

8. The commodity information processing apparatus according to claim 5, wherein the control section determines not to cut the roll paper by the cutter in a case where a commodity is recognized by the recognition section before the cutter cuts the roll paper.

9. The commodity information processing apparatus according to claim 5, further comprising:

a reuse area setting section configured to set an area from front end of the roll paper to a position at a given distance from the front end as a reuse area; wherein the control section controls the erasing head so as not to erase the color of the color erasable ink printed on the reuse area of the roll paper.

10. The commodity information processing apparatus according to claim 5, wherein the control section stores a history of the color erasing processing carried out by the erasing head as the erasing history, and controls the cutter and the conveyance section to cut, by the cutter, an area which has been subjected to color erasing processing for a number of times equal to a pre-set limit number of times of erasing.

* * * * *